US006478548B1

(12) United States Patent
Auer

(10) Patent No.: US 6,478,548 B1
(45) Date of Patent: Nov. 12, 2002

(54) DEVICE FOR ADJUSTING HYDRAULIC EQUIPMENT

(75) Inventor: Johann Auer, Losenstein (AT)

(73) Assignee: Weber-Hydraulik GmbH, Losenstein (AT)

( * ) Notice: Subject to any disclaimer, the term of this patent is extended or adjusted under 35 U.S.C. 154(b) by 0 days.

(21) Appl. No.: 09/701,061

(22) PCT Filed: May 18, 1999

(86) PCT No.: PCT/AT99/00125

§ 371 (c)(1),
(2), (4) Date: Nov. 20, 2000

(87) PCT Pub. No.: WO99/61797

PCT Pub. Date: Dec. 2, 1999

(30) Foreign Application Priority Data

May 22, 1998 (AT) ..... 338/98 U

(51) Int. Cl.[7] ..... F04B 1/06
(52) U.S. Cl. ..... 417/221
(58) Field of Search ..... 417/221, 218, 417/212

(56) References Cited

U.S. PATENT DOCUMENTS

| | | | | |
|---|---|---|---|---|
| 2,356,993 A | | 8/1944 | Glasner et al. | |
| 2,539,277 A | | 1/1951 | Schroepfer | |
| 2,612,837 A | | 10/1952 | Midgette | |
| 2,709,408 A | | 5/1955 | Orshansky | |
| 3,492,948 A | | 2/1970 | Platt | |
| 3,827,831 A | * | 8/1974 | Lines | 417/273 |
| 3,906,842 A | * | 9/1975 | Sonobe | 417/221 |
| 3,924,490 A | * | 12/1975 | Mills | 475/76 |
| 4,041,800 A | | 8/1977 | Sato et al. | |
| 4,261,228 A | | 4/1981 | Eagan, Sr. | |
| 4,545,732 A | * | 10/1985 | Oberdorfer | 417/270 |
| 4,768,422 A | * | 9/1988 | Swinney | 417/221 |
| 4,777,866 A | * | 10/1988 | Tan | 417/221 |
| 5,280,745 A | * | 1/1994 | Maruno | 417/221 |
| 5,340,285 A | * | 8/1994 | Reinartz et al. | 303/116.4 |
| 5,368,448 A | * | 11/1994 | Maruno et al. | 417/221 |
| 6,162,022 A | * | 12/2000 | Anderson et al. | 417/213 |

FOREIGN PATENT DOCUMENTS

| | | |
|---|---|---|
| DE | 543934 | 1/1932 |
| DE | 11 12 431 | 8/1961 |
| DE | 41 32 456 | 4/1993 |
| FR | 841996 | 6/1939 |
| FR | 930884 | 9/1947 |
| FR | 2321608 | 3/1977 |
| GB | 1149273 | 4/1969 |

* cited by examiner

*Primary Examiner*—Teresa Walberg
*Assistant Examiner*—Daniel Robinson
(74) *Attorney, Agent, or Firm*—Collard & Roe, P.C.

(57) ABSTRACT

The invention relates to a radial piston pump (1) with an eccentric actuator unit (19), the radial piston pump (1) having several pumping units (20) driven by a common drive shaft (18). A central axis (35) of a circumferential bearing surface (37) of an actuator eccentric (33) designed for displacing pump pistons (24) of the pumping units (20) extends at an angle relative to a central axis (31) of the drive shaft (18) or an actuator unit (19) incorporating the actuator eccentric (33).

20 Claims, 5 Drawing Sheets

DEVICE FOR ADJUSTING HYDRAULIC EQUIPMENT

The invention relates to a radial piston pump having an eccentric actuator unit with several pump pistons driven by a common drive shaft.

A number of radial piston pumps are known, by means in which a delivery volume can be adjusted by means of an eccentric. The disadvantage of these is that the eccentric surfaces run parallel with a drive shaft and the delivery volume can therefore only be adjusted by displacing the central axis of the eccentric relative to the central axis of the drive shaft. The delivery volume is often adjusted purely on the basis of pressure. Radial piston pumps of this type are very complex to manufacture because a separate drive has to be provided for the pressure medium, to which external pressure is applied.

The objective of the invention is to provide a pumping system of the type having a radial piston pump with an eccentric actuator unit, which will allow largely automatic regulation of the delivery volume depending on the system pressure during operation.

This object is accomplished by the invention with a radial piston pump comprising a plate-shaped housing having bores for conveying a fluid medium, a drive unit joined to the housing at one side thereof and having a drive shaft projecting through the housing, a storage container for the fluid medium fluid-tightly joined to the housing at a side thereof opposite to the one side, and pumping units comprising pump pistons arranged at the opposite side of the plate-shaped housing, the pump pistons circumferentially surrounding the drive shaft and being radially displaceable relative thereto. An eccentric actuator unit radially displaces the pump pistons, the actuator unit having an axially extending bore receiving the drive shaft, being axially displaceably mounted on the drive shaft and keyed thereto for rotation therewith, and the actuator unit to the axis of the drive shaft and a like inclined surface bearing on the pump pistons.

The surprising advantage of this system is that in order to regulate the pumping rate of a pump equipped with any number of pumping units to cope with the demands of prevailing requiroments, a mechanically simple and hence reliable control system is provided between the drive unit and the pumping system, designed to permit automatic regulation so that predetermined work rates can be obtained irrespective of the consumers used, and the strokes of the pump pistons and hence their delivery rate may be varied.

A reproducible initial position will remain unchanged for a predetermined, structurally created eccentricity if a biasing mechanism is provided for displacing the actuator unit into an end position against a stop axially spaced from the housing, the biasing mechanism comprising return springs arranged in, and substantially parallel to, the axially extending actuator unit bore.

A bearing design which is capable of absorbing the spring forces with virtually no wear is provided with an annular bearing seat supporting the return springs at ends thereof opposite the stop. The bearing seat is a ring surrounding a cylindrical portion of the actuator unit axially projecting from the cylindrical body having an inclined axis, further comprising a radial bearing supporting the bearing ring and bearing the cylindrical portion of the actuator unit.

If a spring couples the actuator unit to the drive shaft for locking the actuator unit against rotation relative to the drive shaft, the rotary motion of the drive shaft is transmitted via the biasing spring to the actuator unit free of backlash, without restricting the capacity of the actuator unit to move axially on the drive shaft.

Advantageously, the radial piston pump further comprises a casing circumferentially surrounding an end of the actuator unit remote from the drive unit, and an actuator arranged in the casing. A thrust bearing is arranged between a pressure plate of the actuator and an end face of a recess of the actuator unit. A biasing mechanism displaces the actuator unit into an end position against the pressure plate of the actuator, and the actuator comprises a pressure medium activated plunger exerting an axial bias force opposite the bias force exerted by the biasing mechanism. The plunger is connected to the pressure plate by a press-fit to prevent displacement.

As a result of these, the delivery volume can be controlled externally in order to adjust the pumping rate to an adjustment curve predetermined on the basis of specific operating conditions and the mechanism used for this purpose can be obtained using simple and reliable transmission components known from the prior art.

If the pumping units have outlets communicating with each other by bores in the plate-shaped housing, the bores constituting pressure lines for the fluid medium, assembly is simplified since loss of load due to the pipework is reduced to a minimum and faults caused by leakage which might otherwise occur due to the stress of vibration on screw fittings and pipework are avoided.

A compact structure is provided if a flanged bearing plate affixes the plate-shaped housing and a pump housing for the pump pistons arranged at the opposite side thereof to the drive unit.

Advantageously, the pistons carry piston shoes in contact with the inclined bearing surface of the cylindrical body of the actuator unit. The piston shoes are able to move on all sides enabling them to adapt to every possible angle.

The invention will be described in more detail with reference to the examples of embodiments illustrated in the drawings.

Of these:

Figure 1:
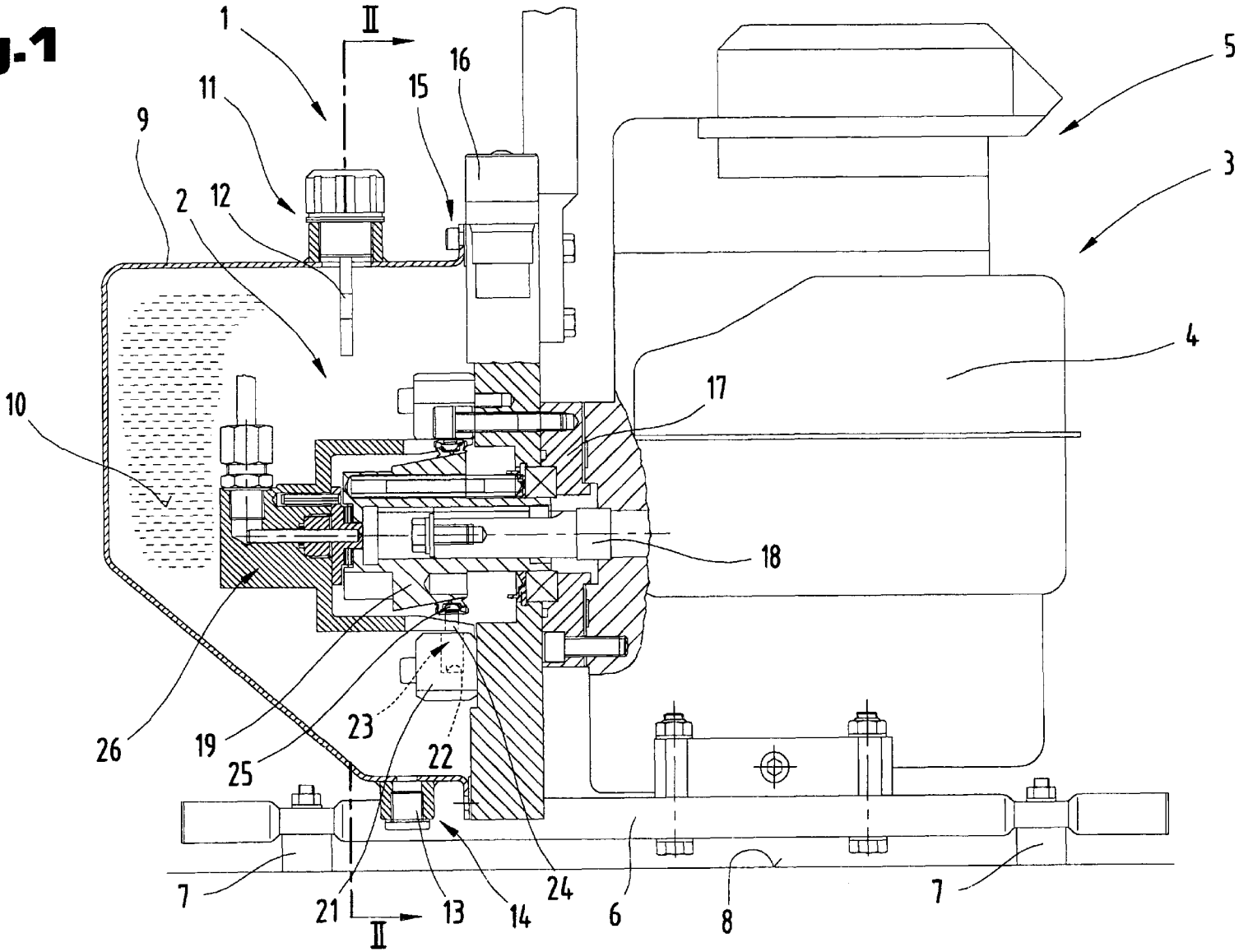
FIG. 1 is a simple schematic illustration of the structure of a radial piston pump with an integrated actuator unit of the type proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
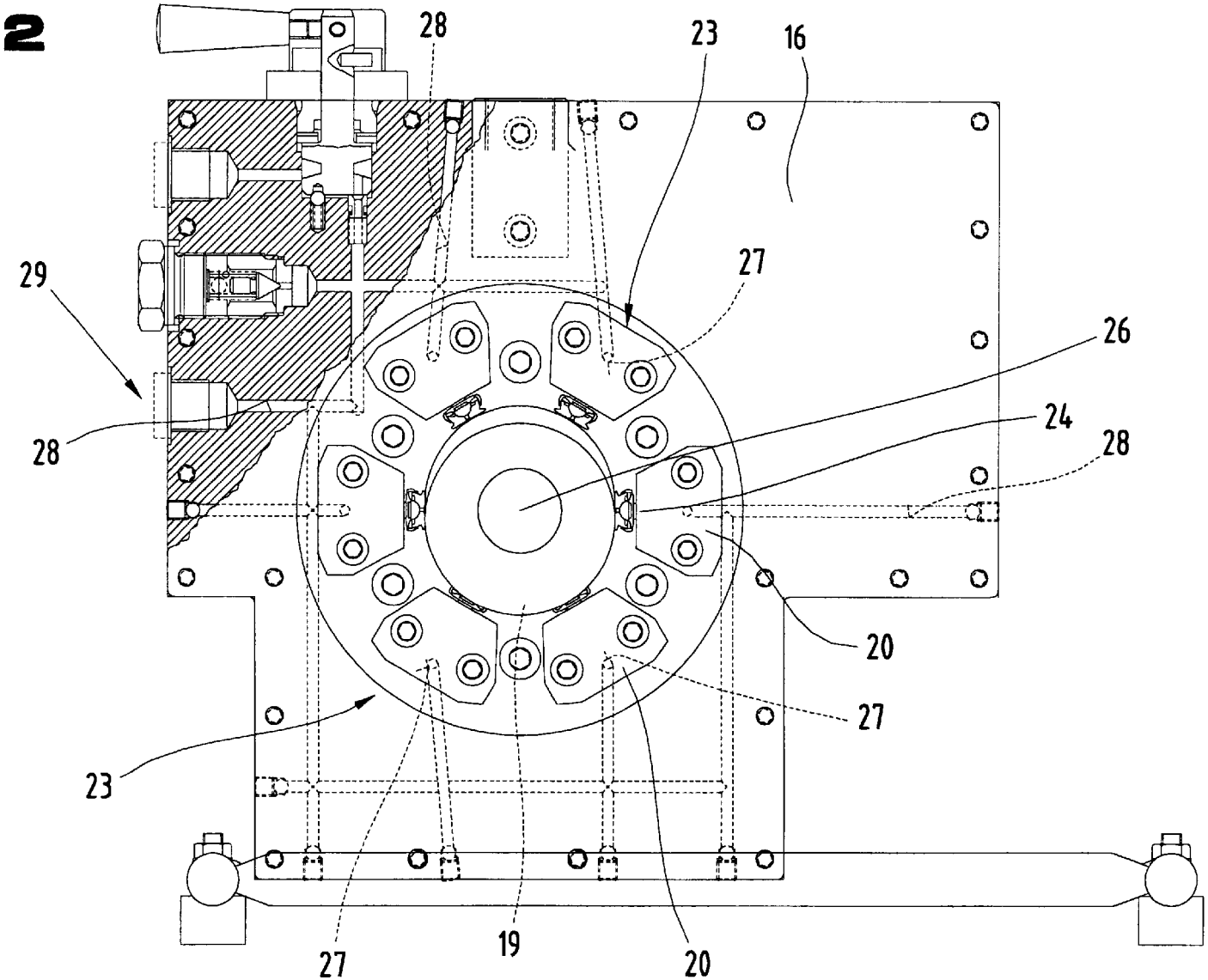
FIG. 2 is a side view of the radial piston pump illustrated in FIG. 1.

FIGS. 1 and 2 illustrate a radial piston pump 1, consisting of a pumping system 2 and a drive unit 3. The drive unit 3 in this example has a motor 4, which is activated by a control system 5. The radial piston pump 1 is mounted on a base plate 6 or a tubular frame, etc., which is preferably supported on a standing surface 8 by means of vibration-damping feet 7. The pumping system 2 is arranged in a supply container 9 and is constantly surrounded by the medium 10 contained in the supply container 9. This medium 10 is preferably a pressuring medium such as hydraulic oil, for example. The supply container 9 is provided with an inlet opening 11 enabling it to be filled with the medium 10 and the closure system is provided with a liquid level indicator 12 of a known type by means of which the level of the supply container 9 is controlled. At the deepest point of the supply container 9 is an outlet opening 14 closed off by a screw 13, by means of which the supply container 9 is emptied, for example to change the medium 10 at regular intervals.

The supply container 9 is preferably made from a known type of sheet metal and is joined to a housing component 16 by means of a flange 15 running around the end face, e.g. is screwed thereto, although other possible fixing means designed to provide a tight seal may also be used. The housing component 16 is joined to a flanged plate 17, which is designed to receive the drive unit 3 disposed opposite the housing component 16, e.g. having a centring shoulder to provide a centred mounting of the motor 4.

The pumping system 2 in turn consists of a drive shaft 18 projecting out from the drive unit 3 or the motor 4 and an actuator unit 19 slidably mounted thereon in an axial direction and cooperating with the pumping units 20 mounted on the housing component 16.

The pumping units 20 are standard delivery components for a medium 10, such as hydraulic oil, and as such are of the self-suction type. A pump piston 24 provided in a bore 22 of a pump housing 21 adjustably acts against the action of a spring 23. In an end region projecting out from the pump housing 21, the pump piston 24 has what will be referred to as a piston shoe 25, which bears on the actuator unit 19 due to the action of the spring 23 or the force applied by the medium 10 to the pump piston 24.

In the embodiment illustrated here, an actuator 26, supplied by an external pressure generator, is provided as a means of displacing the actuator unit 19 in the axial direction of the drive shaft 18, enabling the actuator unit 19 to be displaced along the drive shaft 18 to produce an externally definable volume and pressure curve of the pumping system 2.

As may be seen more clearly from FIG. 2, pumping units 20, of which there are six for example, are disposed on the housing component 16 laid out radially around the drive shaft 18. The number of pumping units may be freely selected and will depend on requirements, particularly with regard to the delivery rate of a radial piston pump 1 of this type. As mentioned above, these pumping units 20 are of the self-suction type, which suck in the medium 10 through inlet orifices when an under-pressure prevails in the bore 22 and discharge it via pump outlets 27 when the pump piston 24 is displaced by means of the actuator unit 19 as the pressure builds up. The pump outlets 27 of the pumping units 20 are connected to one another to form a line by means of bores 28 provided in the housing component 16, so that a common pressure is allowed to build up across all pumping units 20. As a result of this design in which all pump outlets 27 are connected to one another in a line across the bores 28, the medium 10 can be discharged at an outlet 29 at a relatively constant pressure and fed to a consumer, e.g. a hydraulically operated tool.

Figure 3:
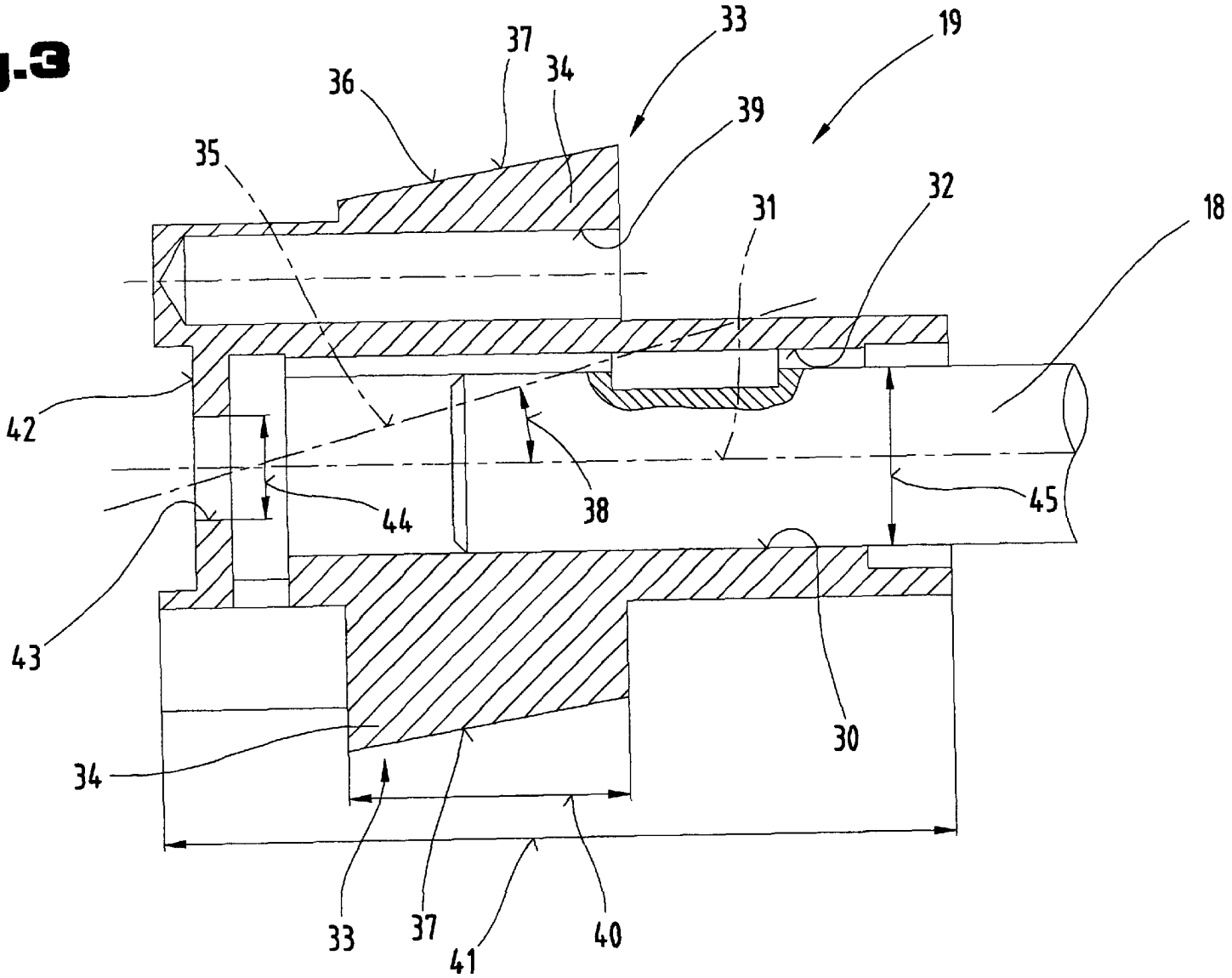
FIG. 3 is a side view of the actuator unit proposed by the invention, seen in section.

FIG. 3 shows a side view of the actuator unit 19, seen in section. The actuator unit 19 has a mounting bore 30 for receiving the drive shaft 18 of the drive unit 3. The mounting bore 30 and the drive shaft 18 of the drive unit 3 have a common central axis 31, which extends across the entire length of the actuator unit 19, thereby enabling it to rotate about the central axis 31. Also disposed in the mounting bore 30 and extending across the entire length of the mounting bore 30 is a groove-shaped recess 32, provided as a means of receiving a retaining means, such as a biasing spring for transmitting the rotary motion of the drive shaft 18. The actuator unit 19 forms an actuator eccentric 33, provided as an inclined cylindrical body 34, a central axis 35 of the cylindrical body 34 running at an acute angle to the central axis 31 of the drive shaft 18.

A lateral surface 36 of the actuator eccentric 33 or cylindrical body 34 forms a bearing surface 37 for the pump pistons 24. Consequently, the central axis 35 of the circumferential bearing surface 37 of the actuator eccentric 33 is directed at an angle, in particular an acute angle 38 relative to the central axis 31 of the drive shaft 18 or the actuator unit 19 incorporating the actuator eccentric 33. The actuator unit 19 also has mounting bores 39 extending parallel with its central axis 31, which may be designed to receive any type of return members for the actuator eccentric 33 and the actuator unit 19. A length 40 of the actuator eccentric 33 measured parallel with the central axis 31 of the actuator unit 19 is essentially smaller than a total length 41 of the actuator unit 19.

A recess 42 or a bore 43 for receiving a thrust bearing is provided on the end face of the actuator unit 19 remote from the drive unit 3. This bore 43 is of a slightly smaller diameter 44 than the mounting bore 30, preventing the drive shaft 18 from projecting fully through the actuator unit.

The angle 38 subtended by the central axis 31 of the drive shaft 18 and the central axis 35 of the actuator eccentric 33 or cylindrical body 34 can be freely selected depending on the desired displacement characteristics but is between approximately 5° and 15°.

Figure 4:
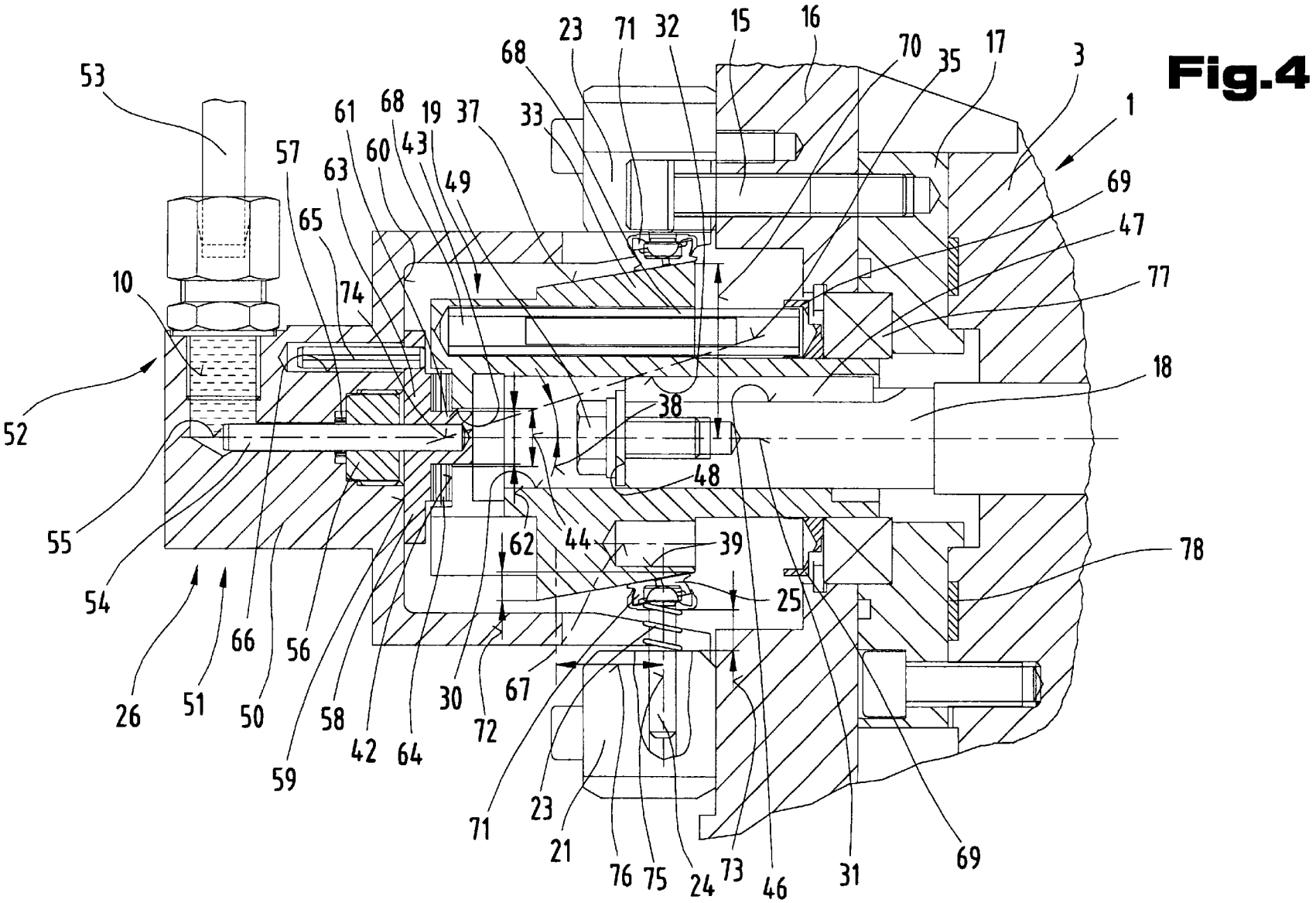
FIG. 4 illustrates the pump housing with the mounted actuator unit and actuator proposed by the invention to enable an axial displacement of the actuator unit.

FIG. 4 provides a detailed diagram of the pumping system 2 with the actuator 26 and the actuator unit 19 or actuator eccentric 33 mounted on the drive shaft 18. As may be seen from this diagram, the actuator unit 19 with its actuator eccentric 33 is axially pushed onto the drive shaft 18 so that a central axis 31 of the actuator unit 19 is aligned with a central axis of the drive shaft 18. As a result of this layout, the actuator unit 19 incorporating the actuator eccentric 33 is mounted on the drive shaft 18 so as to slide axially along the central axes 31 of the actuator unit 19 and the drive shaft 18. In order to transmit the rotary motion of the drive shaft 18 to the actuator unit 19 incorporating the actuator eccentric 33, a biasing spring 47 is inserted in the recess 32 of the mounting bore 30 described above and in the recess 46 in the drive shaft 18 matching the recess 32. The purpose of this biasing spring 47 is to transmit the rotary motion of the drive shaft 18 to the actuator unit 19 and permit an axial displacement of the actuator 19 incorporating the actuator eccentric 33 in an axial direction along the central axis 31, i.e. the actuator unit 19 with the actuator eccentric 33 is locked onto the drive shaft 18 in rotation by the biasing spring 47. A screw 49 is screwed into an end face 48 of the drive shaft 18 to prevent any axial displacement of the biasing spring 47.

In the embodiment illustrated here, depicting one possible embodiment of the actuator 26 used to displace the actuator unit 19, a housing 50 is mounted more or less coaxially on the housing component 16 surrounding the actuator unit 19 and is provided with orifices so that the actuator unit 19 as a whole runs in an oil bath formed by the medium 10.

To enable an axial displacement of the actuator unit 19 with the actuator eccentric 33 as described above, the actuator 26 is arranged in and end region 51 of the housing 50 remote from the drive unit 3, which may be operated by an external pressure system or by any other drive unit. The actuator 26 has a plunger 54 to which pressure is applied via a connecting piece 52 and a supply line 53, a central axis 55 of the plunger 54 running along a central axis of the actuator unit 19 and a central axis 31 of the drive shaft 18. Prior to assembling the housing 50, this plunger 54 is positioned on the housing component 16 by means of a threaded member 56, in which the plunger 54 is mounted in a bearing seat. The threaded member 56 has a peripheral seal 57 in the direction towards the connecting piece 52 in order to prevent any pressurised liquid from penetrating the threaded member 56, ensuring that smooth operation of the plunger 54 will not be adversely affected.

A pressure plate 58 is attached to the end region of the plunger 54 facing the actuator unit 19. This pressure plate 58 has an approximately T-shaped cross section and lies with an end face 59 co-operating with the plunger 54 on an internal face 60 of the housing 50 when the plunger 54 is in the non-pressurised state so that the pressure plate 58 co-operates with the actuator unit 19 at its housing-side end region.

A projection 61 of the plunger 54 extending along the central axis 55 is of a diameter 62 which is preferably smaller than the diameter 44 of the bore 43 in the actuator unit 19. Arranged on or attached to the radial peripheral flank 63 of the pressure plate 58 is a thrust bearing 64, which ensures that the actuator unit 19 can rotate unhindered even though the plunger 54 is mounted on the actuator unit 19. At least one guide pin 65 is provided in the flank 63 by means of a push-fit mechanism and extends in the direction of the connecting piece 52. This guide pin 65 is slidably mounted in an axial direction in a bore 66 provided in the housing 50. The pressure plate 58 is locked onto the plunger 54 by the guide pin 65 to prevent rotation and exerts a displacement force on the actuator unit 19 rotating with the drive shaft 18 by means of a thrust bearing 64 inserted in between.

Mounting bores 39 are arranged in the actuator unit 19 or the actuator eccentric 33, the central axes 67 of these mounting bores 39 extending parallel with the central axis 55. These mounting bores 39 are designed to receive return springs 68, which bear against a bearing seat 69 and absorb an axial force on the housing component 16 by means of a bearing arrangement. The return springs 68 or mounting bores 39 may be of any chosen length but the return forces must be distributed around the periphery so that they ensure that the actuator unit 19 slides parallel with the central axis 31 of the drive shaft 18.

The pumping units 20 are arranged in a star-shaped layout on the housing component 16 at a distance 70 from the central axis 31 of the drive shaft 18, these pumping units 20 incorporating the pump pistons 24 extending perpendicular to the central axis 31. In end region of the pump piston 24 disposed in the direction of the actuator unit 19, piston shoes 71 which can move on all sides are provided, and bear on the circumferential lateral face 37 of the actuator eccentric 33. Because they are able to move on all sides, the piston shoes conform to an inclined position of the bearing surface 37. As a result, the pumping units 20 are driven by means of the actuator eccentric 33, the central axis 35 of the actuator eccentric 33 being disposed at an acute angle 38 relative to the central axis 31 of the drive shaft 18 and actuator unit 19. Because of this angled positioning of the central axis 31 relative to the central axis 35, these two central axes 31, 35 intersect, this point of intersection giving the zero point of the eccentricity, thereby enabling zero delivery by the pumping units 20.

Because the actuator unit 19 and the actuator eccentric 33 are of an axially slidable design, the different possible degrees of eccentricity can be used to produce different strokes of the pump pistons 24 of the pumping units 20, enabling the delivery rate of the pumping units 20 to be varied accordingly.

By providing the actuator eccentric 33 in the design of an angled cylindrical body 34 and as a result of the angled contour of the bearing surface 37 relative to the central axis 31, the piston shoes 71 can be positioned at an angle causing them to exert an axial reaction force on the actuator eccentric 33. The self-generated pressure of the system or an external control pressure also acts on the plunger 54. A force is generated from the surface of the plunger 54 which, combined with the reaction force generated by the angled positioning of the piston shoes 71, pushes the actuator eccentric against the resilient forces of the return springs 68 until the forces reach equilibrium. The axial force needed to displace the actuator eccentric 33 can now be increased as a higher external control pressure is applied to the plunger 54 via the connecting piece 52 and the supply line 53, enabling the actuator unit 19 to be pushed farther along the central axis 3 1. The crucial factor here is that an actuator 26 for the actuator unit 19 co-operates with the pressure plate 58 in order to overcome the return force of the return springs 68, the actuator 26 being provided as a plunger 54 mounted so as to be axially slidable in the threaded member 56.

Looking more closely at the actuator unit 19 incorporating the actuator eccentric 33, it may be seen that the actuator eccentric 33 has a stroke height 72 which can be freely selected on the basis of an axial displacement of the actuator unit 19 or actuator eccentric 33. This stroke height 72 corresponds to a piston stroke 73 of the pump piston 24, demonstrating how the degree of eccentricity of the actuator eccentric 33 and the stroke height 72 of the pump piston 24 depend one on the other.

As also illustrated, the central axis 35 of the actuator eccentric 33, provided here as an angled cylindrical body 34, extends at an acute angle 38 and intersects the central axis 31 of the drive shaft 18 and the actuator unit 19 at a zero point 74. The diagram in FIG. 4 shows the maximum delivery rate of the pumping units 20. By displacing the actuator unit 19 in the direction of the drive unit 3, the eccentricity of the angled cylindrical body 34 relative to the central axis 31 is reduced. As a result, the piston stroke 73 of the pump pistons 24 with their piston shoes 71 along the central axis 75 reduces and the delivery rate is reduced. The actuator unit 19 can be pushed by the maximum displacement path 76 along its central axis 31, producing the desired structure dependent minimum delivery rate. The layout may be such that a displacement path 76 is selected to be of a size such that the central axis 75 of the piston pumps 24 overlaps the intersection point 74 with the central axes 31 and 35. In this position, the radial piston pump 1 delivers a zero quantity when the actuator unit 19 or the actuator eccentric 33 is rotated.

As may also be seen from FIG. 4, the bearing seat 69 is of a circumferential design so that it is displaced through the same rotary motion as the actuator unit 19, thereby assuming the bearing function for the return springs 68. The bearing seat 69 simultaneously restricts the displacement path 76. In principle, it should be pointed out that these return springs 68 stabilise the actuator unit 19 in the position illustrated in FIG. 4 and if there is any axial displacement of the actuator unit 19 in the direction of the drive unit 3, it must be possible to overcome the retaining force of these return springs 68 by means of the pressure plate 58 and the plunger 54 operated by the pressure medium.

As may also be seen from the diagram, a radial bearing 77 is provided on the return springs 68 or the bearing seat 69 in the direction towards the drive unit 3. In order to prevent leakages, the peripheral seal 78 is provided between the flanged plate 17 and the drive unit 3 as well as a peripheral seal 85 between the flanged plate 17 and the housing component 16. Depending on the type of drive unit, it may be necessary to provide a washer—not illustrated here—on the drive shaft 18.

Figure 6:
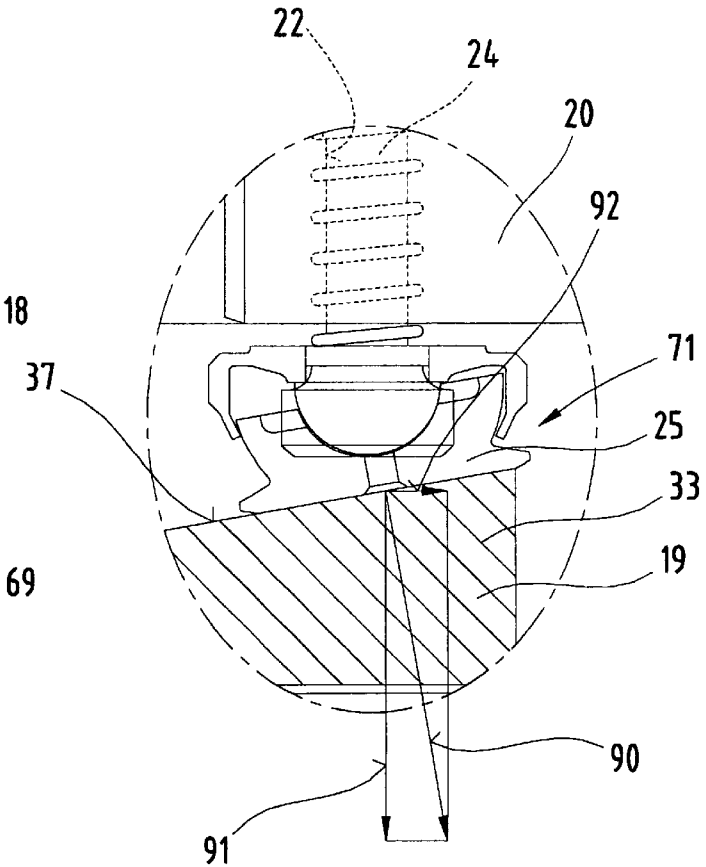
FIG. 6 is a detailed illustration showing the forces that are applied by the actuator unit illustrated in FIG. 5.
Figure 5:
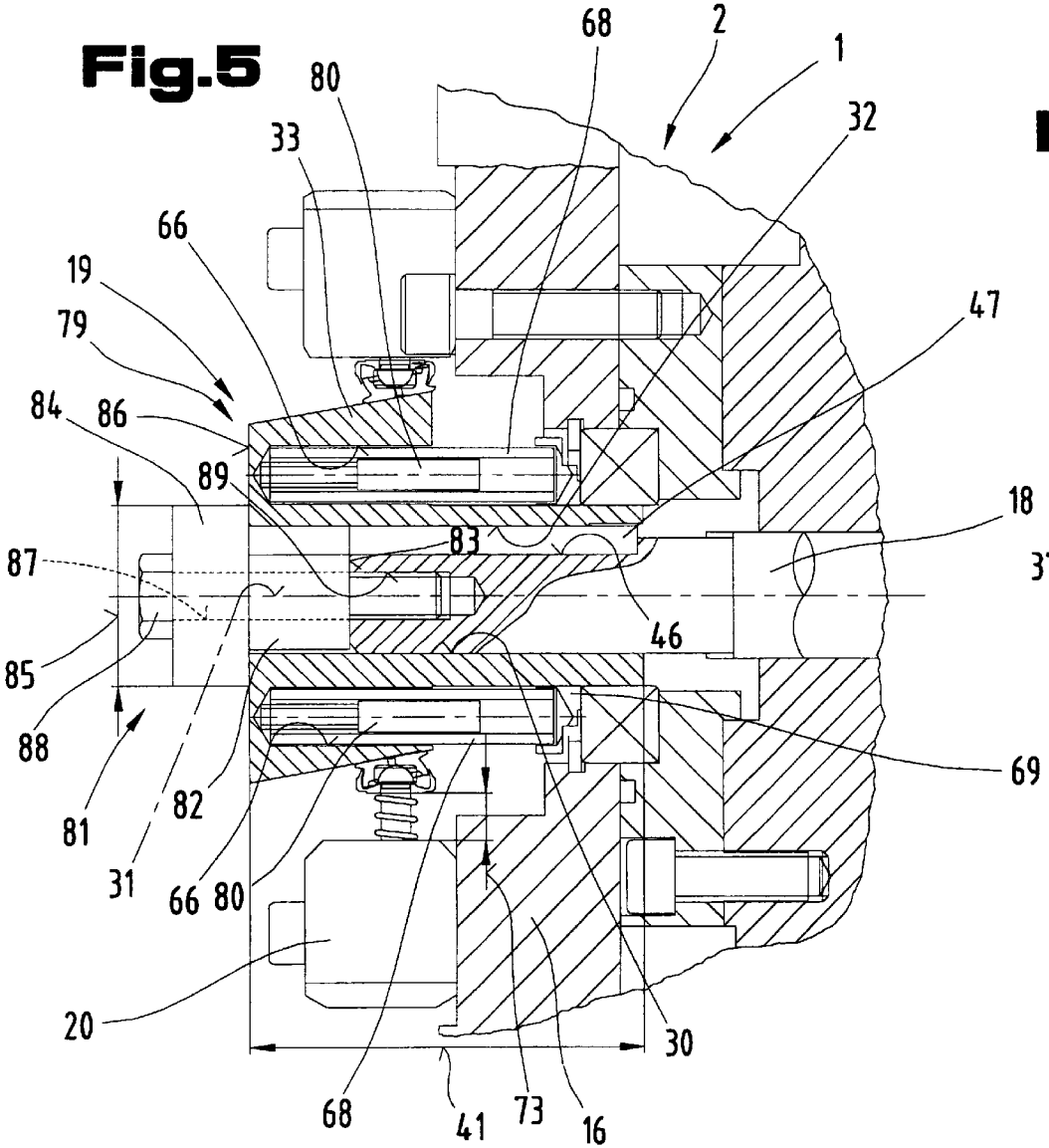
FIG. 5 illustrates another embodiment enabling axial displacement of the actuator unit proposed by the invention.

FIGS. 5 and 6 illustrate another embodiment of the pumping system 2 proposed by the invention.

In this embodiment, the delivery volume of the pumping units 20 is automatically regulated to produce a predetermined system pressure without any external control. The same reference numbers will be used for these drawings as those used for components already described above in relation to the other drawings. Illustrated here are the housing component 16 with the pumping units 20 and the drive shaft 1 8 with the actuator unit 19 or actuator eccentric 33. As may be seen from this diagram, the actuator unit 19 with its actuator eccentric 33 is pushed axially onto the drive shaft 18 so that a central axis of the actuator unit 19 is merged with the central axis of the drive shaft 18. As a result of this arrangement, the actuator unit 19 incorporating the actuator eccentric 33 is mounted on the drive shaft 18 so that so that it can be displaced axially along the central axes 31 of the actuator unit 19 and the drive shaft 18 one top of the other. In order to transmit the rotary motion from the drive shaft 18 to the actuator unit 19 incorporating the actuator eccentric 33, a biasing spring 47 is inserted in the recess 32 in the mounting bore 30 and in a recess 46 in the drive shaft 18 corresponding to the recess 32. This biasing spring 47 is used purely to transmit the rotary motion of the drive shaft 18 to the actuator unit 19 but permits an axial displacement of the actuator unit 19 incorporating the actuator eccentric 33 along the central axis 31 in an axial direction.

The return springs 68 are supported by internally disposed pins 80, designed to prevent any deformation or kinking in the return springs 68 if subjected to high stress.

Arranged on the drive shaft 18 at the end region 79 of the actuator unit 19 remote from the drive unit 3 is a casing 81, forming a circumferential flange and an end stop for the axial displacement of the actuator unit 19 in its position at a distance from the drive unit 3. A base 82 of the stop mechanism 81 projects into the mounting bore 30 of the actuator unit 19 and its end face 83 facing the drive shaft 18 bears on the end face 48 thereof. A flank 84 of the stop mechanism 81 has a larger diameter 85 than the end-to-end bore 30 of the actuator unit 19. As a result of this layout, the flank 84 of the stop mechanism 81 lies against an end face 86 of the actuator unit 19, thereby securing the actuator unit 19 in the position it assumes due to the return springs 68. The stop mechanism 81 has an end-to-end bore 87, through which a screw 88 is inserted, thereby securing the stop mechanism 81. A blind bore 89 is provided in the end face 48 of the drive shaft 18, into which the screw 88 is screwed, thereby securing the stop mechanism 81 on the drive shaft 18. The stop mechanism 81 also prevents any axial displacement of the biasing spring 47, so that the actuator unit 19 is locked onto the drive shaft 18 in rotation.

The delivery volume is adjusted by axially displacing the actuator unit 19 along the drive shaft 18 as follows.

In the illustration provided here and when the drive shaft 18 is rotated, a maximum delivery volume is reached because in this position the actuator eccentric 33 exhibits the maximum eccentric stroke and the pump pistons 24 of the pumping units 20 in turn have the biggest piston stroke 73. As the pump pistons 24 are retracted from the pumping units 20, the surrounding medium 10 is sucked in , compressed by the returning pump pistons 24 and discharged via a non-return valve in the pumping unit 20 to a pressure system or a consumer.

The operating principle of the pumping system 2 will now be described below with reference to FIGS. 5 and 6, this operating principle clearly also being applicable to FIGS. 1 to 4 described earlier.

It should be pointed out that the desired axial displacement of the actuator unit 19 is achieved by the effect of the force applied by the pump pistons 24 and the piston shoes 71. By means of the pumping units 20 disposed radially around the actuator unit 19, a specific delivery rate is obtained as a working pressure gradually builds up in the pressure system and the consumers. As the requisite working pressure builds up within the pressure system, the pressure on the pump pistons 24 increases. This pressure is transmitted across the piston shoes 71 to the actuator unit 19 or the actuator eccentric 33 or on the bearing surface 37 thereof extending at an angle to the central axis 31 of the actuator unit 19, producing a perpendicular compressive force 90 acting on the bearing surface 37. This compressive force 90 is now broken by a parallelogram of forces into a radially acting force component 91 and an axially acting force component 92.

If the compressive force 90 increases further due to a rising consumption pressure, the axial force component 92 becomes so high that it causes the actuator eccentric 33 or the actuator unit 19 to be displaced in an axial direction and in the direction of the force component 92 due to the angled disposition of the bearing surface 37. In principle, displacement of the actuator unit 19 in the axial direction occurs when the axially acting for component 92 exceeds the return force of the returns springs 68 acting against it. As a result of this displacement, the piston stroke 73 is reduced, reducing the delivery rate of the radial piston pump 1 or the pumping units 20 accordingly. The displacement of the actuator unit 19 or the actuator eccentric 33 persists until an equilibrium is reached between the resilient force of the return springs 68 and the axially acting force component 92 of the compressive force 90. Accordingly, the smaller the piston stroke 73 becomes, the more the delivery rate of the radial piston pump 1 decreases until only the line losses of a consumer or of the pressure system are being covered.

If the system pressure is then reduced or if a consumer is placed out of action, the compressive force 90 on the pump pistons 24 or on the bearing surface 37 of the actuator eccentric 33 decreases. The axial force component 92 of the compressive force 90 also decreases as a result and falls in terms of value below the return force of the return springs 68. The result of this layout is that if a higher delivery rate is required, the actuator unit 19 or the actuator eccentric 33 is returned to its original position and the pump pistons 24 returned to their largest possible piston stroke 73.

One particular advantage of this arrangement is that, due to the stepless displacement of the actuator unit 19, the delivery rate can be adjusted to suit any requirements so that the radial piston pump 1 operates in accordance with performance characteristics which rise and fall relatively uniformly. Furthermore, different pressure ranges can be set for the radial piston pump 1 by adjusting the spring force of the return springs 68.

Finally, for the sake of completeness, it should be reiterated that the compressive force 90 acts perpendicularly on the angularly disposed bearing surface, resulting in a force component 92 which acts axially on the actuator unit 19 or the actuator eccentric 33, so that the compressive force 90 acting via the pump pistons 24 and hence the axially acting force component 92 increase depending on the delivery volume due to an increase in the system pressure. Furthermore, as the axially acting force component exceeds the opposing return force of the return springs 68, displacement of the actuator unit 19 is initiated, this displacement of the actuator unit 19 causing a reduction in the piston stroke 73 of the pump pistons 24 of the pumping units 20 via the actuator eccentric 33 and hence also a decrease in the delivery volume. This displacement of the actuator unit 19 in the axial direction continues until an equilibrium is reached between the return force of the return springs 68 and the axially acting force component 92 of the compressive force 90, thereby producing a uniformly rising or falling output curve of the radial piston pump 1 due to the stepless displacement of the actuator unit 19 via the actuator eccentric 33.

For the sake of good order, it should finally be pointed out that in order to provide a clearer understanding of the structure of the radial piston pump 1, it and its constituent parts have been illustrated out of scale to a certain extent and/or on an enlarged and/or reduced scale.

The independent solutions to the task proposed by the invention can be found in the description.

Above all, the subject matter of the individual embodiments illustrated in FIGS. 1, 2; 3; 4; 5, 6 can be construed as independent solutions proposed by the invention. The related tasks and solutions can be found in the detailed descriptions relating to these drawings.

LIST OF REFERENCE NUMBERS

1 Radical piston pump
2 Pumping system
3 Drive unit
4 Motor
5 Control System
6 Base plate
7 Foot
8 Standing surface
9 Supply container
10 Medium
11 Inlet opening
12 Liquid level indicator
13 Screw
14 Outlet Opening
15 Flange
16 Housing component
17 Flanged plate
18 Drive shaft
19 Actuator unit
20 Pumping units
21 Pump housing
22 Bore
23 Spring
24 Pump piston
25 Piston shoe
26 Actuator
27 Pump outlet
28 Bore
29 Outlet
30 Mounting bore
31 Central axis
32 Recess
33 Actuator eccentric
34 Cylindrical body
35 Central axis
36 Lateral surface
37 Bearing surface
38 Angle
39 Mounting bore
40 Length
41 Total length
42 Recess
43 Bore
44 Diameter
45 Diameter
46 Recess
47 Biasing spring
48 End face
49 Screw
50 Housing
51 End region
52 Connecting piece
53 Supply line
54 Plunger
55 Central axis
56 Threaded member
57 Seal
58 Pressure plate
59 End face
60 Internal face
61 Projection
62 Diameter
63 Flank
64 Thrust Bearing
65 Guide pin
66 Bore
67 Central axis
68 Return spring
69 Bearing seat
70 Distance
71 Piston shoe
72 Stroke height
73 Piston stroke
74 Zero point
75 Central axis
76 Displacement path
77 Radical bearing
78 Seal
79 End region
80 Pin
81 Stop mechanism
82 Base
83 End face
84 Flank

85 Diameter

86 End face

87 End-to-end bore

88 Screw

89 Blind bore

90 Compressive force

91 Force component

92 Force component

What is claimed is:

1. A radial piston pump comprising (a) a plate-shaped housing having bores for conveying a fluid medium, (b) a drive unit joined to the housing at one side thereof and having a drive shaft projecting through the housing, (c) a storage container for the fluid medium fluid-tightly joined to the housing at a side thereof opposite to the one side, (c) pumping units comprising pump pistons arranged at the opposite side of the plate-shaped housing, the pump pistons circumferentially surrounding the drive shaft and being radially displaceable relative thereto, and (d) an eccentric actuator unit for radially displacing the pump pistons, the actuator unit having an axially extending bore receiving the drive shaft, being axially displaceably mounted on the drive shaft and keyed thereto for rotation therewith, and the actuator unit comprising (1) a cylindrical body having an axis inclined relative to the axis of the drive shaft and a like inclined surface bearing on the pump pistons.

2. The radial piston pump of claim 1, further comprising a biasing mechanism for displacing the actuator unit into an end position against a stop axially spaced from the housing, the biasing mechanism comprising return springs arranged in, and substantially parallel to, the axially extending actuator unit bore.

3. The radial piston pump of claim 2, further comprising an annular bearing seat supporting the return springs at ends thereof opposite the stop.

4. The radial piston pump of claim 3, wherein the bearing seat is a ring surrounding a cylindrical portion of the actuator unit axially projecting from the cylindrical body having an inclined axis, further comprising a radial bearing supporting the bearing ring and bearing the cylindrical portion of the actuator unit.

5. The radial piston pump of claim 1, further comprising a spring coupling the actuator unit to the drive shaft for locking the actuator unit against rotation relative to the drive shaft.

6. The radial piston pump of claim 1, further comprising a casing circumferentially surrounding an end of the actuator unit remote from the drive unit, and an actuator arranged in the casing.

7. The radial piston pump of claim 6, further comprising a thrust bearing arranged between a pressure plate of the actuator and an end face of a recess of the actuator unit.

8. The radial piston pump of claim 7, further comprising a biasing mechanism for displacing the actuator unit into an end position against the pressure plate of the actuator, and the actuator comprises a pressure medium activated plunger exerting an axial bias force opposite the bias force exerted by the biasing mechanism.

9. The radial piston pump of claim 8, wherein the plunger is connected to the pressure plate by a press-fit to prevent displacement.

10. The radial piston pump of claim 1, wherein the pumping units have outlets communicating with each other by bores in the plate-shaped housing, the bores constituting pressure lines for the fluid medium.

11. The radial piston pump of claim 1, further comprising a flanged bearing plate affixing the plate-shaped housing and a pump housing for the pump pistons arranged at the opposite side thereof to the drive unit.

12. The radial piston pump of claim 1, wherein the pump pistons carry piston shoes in contact with the inclined bearing surface of the cylindrical body of the actuator unit.

13. The radial piston pump of claim 12, wherein the piston shoes are universally pivotally mounted on the pumping pistons.

14. The radial piston pump of claim 1, wherein the actuator unit is axially displaceable along a displacement path between end positions wherein the bearing surface of the cylindrical body has a zero eccentricity and a maximum eccentricity.

15. The radial piston pump of claim 14, wherein the displacement path has a length of 8 mm to 30 mm.

16. The radial piston pump of claim 15, wherein the length is about 15 mm.

17. The radial piston pump of claim 1, further comprising means for exerting a perpendicular force on the bearing surface of the cylindrical body of the actuator unit, resulting in a force component acting axially on the actuator unit.

18. The radial piston pump of claim 1, wherein the axis of the drive shaft and the axis of the cylindrical body enclose an angle of approximately 5° to 15°.

19. The radial piston pump of claim 18, wherein the angle is about 10°.

20. The radial piston pump of claim 1, wherein the bearing surface of the cylindrical body of the actuator unit has a maximum eccentricity of about 6 mm.

* * * * *